United States Patent [19]

Huberts et al.

[11] 4,021,206

[45] May 3, 1977

[54] SEPARATING COAL PARTICLES FROM WATER

[75] Inventors: Leo J. Th. J. Huberts, The Hague; Eke Verschuur, Amsterdam, both of Netherlands

[73] Assignee: Shell Oil Company, Houston, Tex.

[22] Filed: Feb. 3, 1976

[21] Appl. No.: 654,816

[30] Foreign Application Priority Data

Feb. 10, 1975 United Kingdom ..... 5482/75
Oct. 31, 1975 United Kingdom ..... 45156/75

[52] U.S. Cl. ..... 44/10 R; 44/24; 241/20

[51] Int. Cl.[2] ..... C10L 5/00; C10L 5/14

[58] Field of Search ..... 44/10 R, 24; 210/78; 241/20, 24

[56] References Cited

UNITED STATES PATENTS

| | | | |
|---|---|---|---|
| 2,842,319 | 7/1958 | Reerink et al. | 241/20 X |
| 3,261,559 | 7/1966 | Yavorsky et al. | 241/24 |
| 3,579,442 | 5/1971 | Gerwig | 210/78 X |
| 3,775,070 | 11/1973 | Messer et al. | 44/10 R |

*Primary Examiner*—Carl F. Dees

[57] ABSTRACT

The invention relates to a process for separating coal particles in a coal/water slurry from water of the slurry by separating the larger coal particles with a relatively small quantity of water from the smaller coal particles with a relatively large quantity of water and then agglomerating the smaller coal particles and separating the agglomerates from the water.

7 Claims, 2 Drawing Figures

SEPARATING COAL PARTICLES FROM WATER

BACKGROUND OF THE INVENTION

In coal markets a premium is frequently placed on coals which have a low dusting tendency and a relatively low free fine ash content. Some customers will also specify a coal particle size range, either coarse or fine. And, it is generally desirable that the coal be relatively dry. Needless to say, this latter feature is particularly difficult to achieve when the coal is derived from a coal/water slurry. Even so, the present invention provides all of the above desired features by a unique process for separating coal from a coal/water slurry, as more particularly described hereinafter.

SUMMARY OF THE INVENTION

It is a purpose of the invention to provide a process for removing water from the coal, supplied as a coal/water slurry, in such a manner that a coal product is obtained which is relatively dry and which has a low dusting tendency.

It is another purpose of the invention to provide a process for use with a coal/water slurry containing moreover free fine ash particles, the process being particularly suitable for removing the free fine ash particles, so that a coal product is obtained having a low free fine ash content, which is relatively dry and which has a low dusting tendency.

The process for separating the coal particles in a coal/water slurry from water of the slurry involves the steps of:

a. supplying the slurry to a separator wherein the larger coal particles together with a relatively small quantity of water are separated from the slurry as supplied, so that a second slurry remains comprising the smaller coal particles and a relatively large quantity of water;

b. withdrawing the said larger coal particles together with a small quantity of water as a product;

c. passing the second slurry to an agglomeration device;

d. introducing a binder and the second slurry into the agglomeration device so that agglomerates of coal particles and binder are formed;

e. separating the agglomerates from the water;

f. withdrawing the agglomerates as a product.

If the coal/water slurry as supplied contains free fine ash particles, most of the said free fine ash articles will remain in the said second slurry after the separation according to step *a*. In that case an attractive embodiment of the invention involves the steps of:

k. passing the second slurry to an agglomeration device;

l. introducing a binder and the second slurry into the agglomeration device so that agglomerates of coal particles and binder are formed;

m. separating the agglomerates from the water containing the free fine ash particles;

n. withdrawing the agglomerates as a product.

In a suitable embodiment of the invention, the separation according to step *a* is carried out by means of a centrifuge.

BRIEF DESCRIPTION OF THE DRAWINGS

The invention will be further explained with reference to the drawings, wherein.

DESCRIPTION OF PREFERRED EMBODIMENTS

Figure 1:
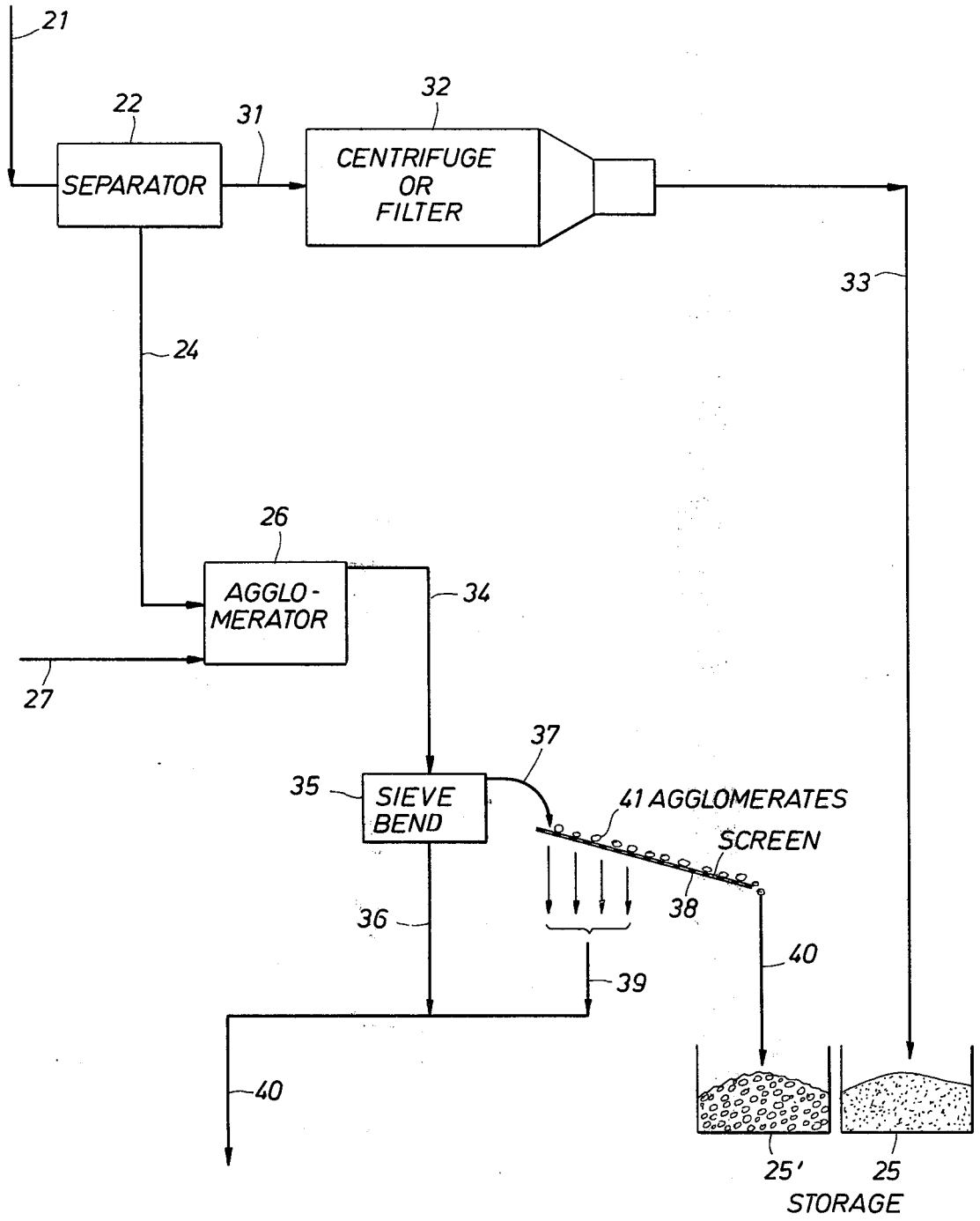
FIG. 1 shows schematically a first embodiment of the process according to the invention.

In the embodiment of the invention as shown in FIG. 1, a coal/water slurry is supplied via a conduit 21 to a separator 22, for example a sieve bend separator. In the separator 22 the slurry is separated into at least two slurry fractions, viz. a fraction containing coarse coal particles, for example larger than  μm and a second fraction containing fine coal particles, for example smaller than 300 μm.

The fraction containing the coarser coal particles is passed via a conduit 31 to a centrifuge or filter 32, wherein the fraction is centrifuged or filtered to a relatively low moisture content consistent with the relatively large size of the coal particles. From the centrifuge or filter 32 the coarser coal particles are then withdrawn as a product and for example passed to storage 25, for example via a conduit 33.

The second slurry, which contains the fine coal particles, leaves the separator 22 and is passed via a conduit 24 to an agglomeration device 26. Such an agglomeration device is generally described in British patent specification No. 846,219, which was published on Aug. 31, 1960.

Through a conduit 27, a binder, preferably a hydrocarbon binder, for example gas oil, is introduced into the agglomeration device 26 as well. In the agglomeration device 26, because of the presence of the binder, the coal particles agglomerate so that agglomerates of coal particles and binder are formed. The agglomerates formed leave the agglomeration device 26 together with the water and are passed through a conduit 34 to a sieve bend 35, wherein most of the water is separated from the agglomerates. The separated water leaves the sieve bend 35 and flows via a conduit 36 to a conduit 40.

The agglomerates 41 leave the sieve bend 35 together with a small quantity of water and are passed to a screen 38. By passing the agglomerates 41 over the screen 38 further water is separated from the agglomerates 41. The separated water leaves the screen and is passed via a conduit 39 to the conduit 40. Via the conduit 40 the separated water is, for example, passed to a suitable disposal system. Instead it is possible to recycle the separated water, if desired. The agglomerates 41 leaving the screen 38 are withdrawn as a product and for example passed to storage 25'.

The coal products 25 and 25' are relatively dry and have a low dusting tendency. The coal products can be further treated, if desired.

The above process is particularly suitable for use with a slurry containing water, fine coal particles, coarse coal particles and free fine ash particles, and when it is desired to obtain a coal product which is relatively dry, which has a low dusting tendency and which has a relatively low free ash content. If the slurry as supplied at 21 contains free fine ash particles, most of the free fine ash particles will remain in the said second slurry fraction, which is passed from the separator 22 via conduit 24 to the agglomeration device 26. The free fine ash particles will remain in the water, separated from the agglomerates 41 by means of sieve bend 35 and by means of screen 38. The free fine ash particles will, for example, be passed, together with the separated water, via conduits 36, 39 and 40 to a disposal system. Instead the said separated water can be purified and be recycled, if desired.

Figure 2:
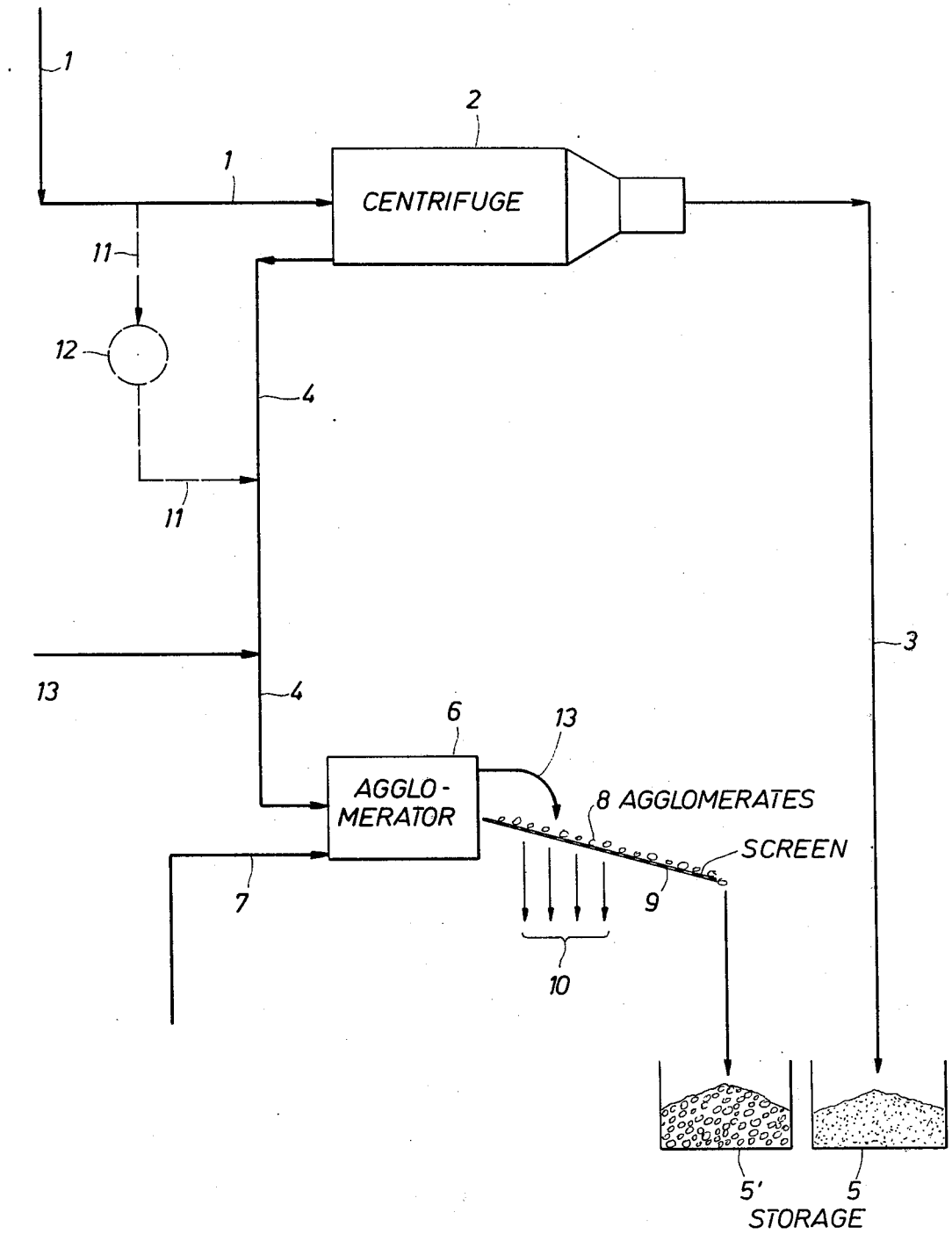
FIG. 2 shows schematically a second embodiment of the process according to the invention.

In the embodiment as shown in FIG. 2, the coal/water slurry is supplied through a conduit 1 to a centrifuge 2. In the centrifuge 2 the larger coal particles together with a relatively small quantity of water are separated from the slurry as supplied to the centrifuge 2 and are withdrawn as product and, for example, passed via line 3 to storage 5. These larger coal particles comprise, for example, about 75% by weight of the solids as present in the slurry as supplied through conduit 1. The larger coal particles have, for example, dimensions which are in the range of about from 40 to 5000 μm. The small quantity of water removed from the centrifuge 2 together with the said larger coal particles is, for example, about 10% to 15% by weight of the larger coal particles. This water is present in the form of a thin layer on each of the said larger coal particles.

By the above-mentioned removal of the larger particles, a second slurry remains which comprises the smaller coal particles and a relatively large quantity of water. This second slurry is removed from the centrifuge 2 and is passed through a conduit 4 to an agglomeration device 6. This second slurry contains most of the smaller coal particles which were originally present in the slurry as supplied through conduit 1. The said second slurry contains, for example, about 25% by weight of the solids as present in the slurry as supplied through conduit 1. The solid particles in the said slurry have dimensions which are in the range of from 0 to 70 μm.

The second slurry is introduced into the agglomeration device 6. Such an agglomeration device is generally described in British patent specification No. 846,219. Through a conduit 7, a binder, preferably a hydrocarbon binder, for example, gas oil, is introduced into the agglomeration device 6 as well. In the agglomeration device 6, because of the presence of the binder, the coal particles agglomerate so that agglomerates of coal particles and binder 8 are formed. The water is removed together with the agglomerates 8 from the agglomeration device 6 via outlet 13 and is passed to a separator, for example a screen 9. The agglomerates 8 are separated from the water and are withdrawn as a product and are, for example, passed to storage 5', together with a relatively small quantity of water. The quantity of the water transported together with the agglomerates 8 to the storage 5' is, for example, about 15–20% by weight of the agglomerates. The separated water leaves the screen 9 at 10 and is passed to a suitable disposal system. Instead the said separated water can be recycled, if desired.

The process according to the invention has the advantage that a product is obtained which is relatively dry. Since the smaller particles in the product are in agglomerated form, the dusting tendency of the product is low. A further advantage of the process according to the invention is that the necessary quantity of binder is small, for example about 5 to 20% by weight of the agglomerates produced in the agglomeration device.

An example of a suitable centrifuge for the above-mentioned purpose is the so-called "Screen Bowl Centrifuge" as marketed by Bird Machine Company, Inc., South Walpole, Massachusetts, U.S.A.

The process as mentioned is as well particularly suitable for use with a slurry containing water, fine coal particles, coarse coal particles and free fine ash particles, and when it is desired to obtain a coal product which is relatively dry, which has a low dusting tendency and which has a relatively low free fine ash content. If the slurry as supplied at 1 contains free fine ash particles most of the free fine ash particles will remain in the said second slurry, which is passed from the centrifuge 2 via conduit 4 to the agglomeration device 6. The free fine ash particles will remain in the water, separated from the agglomerates 8 by means of the screen 9. The separated water 10 containing the said free fine ash particles is, for example, passed to a suitable disposal system. Instead, it is possible to purify the water and to recycle it, if desired.

It is advantageous to arrange a bypass 11 (indicated by a dotted line) between line 1 and line 4, so that at least part of the slurry can be allowed to bypass the centrifuge 2, if desired. This bypass 11 can be opened to a desired degree or be closed by means of a suitable valve 12. By controlling the quantity of slurry bypassing the centrifuge 2, it is possible to control the degree of de-ashing the slurry as supplied through conduit 1.

Attention is drawn to the fact that, if desired, the said second slurry passing through line 4 can be diluted by the introduction of water into line 4 as indicated by reference numeral 13.

If desired, it is possible to convert the coal agglomerates 8 or 41 to briquettes before withdrawing the agglomerates as a product.

Attention is drawn to the fact that more than two fractions may leave the separator 22, for example, three fractions. This third fraction may, for example, contain coal particles having a size range between the size ranges of the coal particles in the two fractions as mentioned.

We claim as our invention:

1. A process for separating coal particles in a coal/water slurry from water of the slurry to form a relatively dry and substantially ash-free, dust-free product of larger coal particles and agglomerates of smaller coal particles comprising the steps of:

a. supplying the slurry to a separator wherein the larger coal particles together with a relatively small quantity of water are separated from the slurry as supplied, so that a second slurry remains comprising the smaller coal particles and a relatively large quantity of water;

b. passing the second slurry to an agglomeration device;

c. introducing a relatively small quantity of binder and the second slurry into the agglomeration device so that agglomerates of the smaller coal particles and the binder are formed; and d. separating the agglomerates from the water.

2. The process as claimed in claim 1, wherein the coal/water slurry contains free fine ash particles which remain in the second slurry after the separation according to step *a*, and remain in the water after separating the agglomerates from the water of the second slurry.

3. The process as claimed in claim 1, wherein the separation according to step *a* is carried out by means of a centrifuge.

4. The process as claimed in claim 1, wherein a further quantity of water is separated from said larger coal particles.

5. The process as claimed in claim 4, wherein the further separation of water from the larger coal particles is carried out by centrifuging.

6. The process as claimed in claim 4, wherein the further separation of water from the larger coal particles is carried out by filtering.

7. The process as claimed in claim 1, wherein, before withdrawing the agglomerates as a product, the agglomerates are converted to briquettes.

* * * * *

UNITED STATES PATENT OFFICE

CERTIFICATE OF CORRECTION

PATENT NO. : 4,021,206

DATED : May 3, 1977

INVENTOR(S) : Leo J.Th.J Huberts; and Eke Verschuur

It is certified that error appears in the above-identified patent and that said Letters Patent are hereby corrected as shown below:

Column 2, line 12, after "than" add --300--.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*